US005426954A

United States Patent [19]

Furukawa

[11] Patent Number: 5,426,954

[45] Date of Patent: Jun. 27, 1995

[54] ICE PIECE MANUFACTURING APPARATUS

[75] Inventor: Yoshio Furukawa, Toyoake, Japan

[73] Assignee: Hoshizaki Denki Kabushiki Kaisha, Japan

[21] Appl. No.: 249,219

[22] Filed: May 26, 1994

[30] Foreign Application Priority Data

Jun. 7, 1993 [JP] Japan ..... 5-036345 U

[51] Int. Cl.[6] ..... F25C 1/12

[52] U.S. Cl. ..... 62/347; 62/352

[58] Field of Search ..... 62/347, 348, 352

[56] References Cited

U.S. PATENT DOCUMENTS 3,430,452 3/1969 Dedricks et al. ..... 62/347 X 5,131,234 7/1992 Furukawa et al. ..... 62/137

FOREIGN PATENT DOCUMENTS 57-202470 12/1982 Japan .

59-161660 9/1984 Japan .

63-14967 1/1988 Japan .

*Primary Examiner*—William E. Tapolcai

*Attorney, Agent, or Firm*—Parkhurst, Wendel & Rossi

[57] ABSTRACT

An ice piece manufacturing apparatus is disclosed in which a guide plate is directly installed to retaining plates through both hook members formed at lower ends of the retaining plates which retain manufacturing plates and long holes opened in brim plates formed at both side edges of the guide plate. A suitable distance necessary for smoothly dropping ice pieces thereby secured between the lower ends of the manufacturing plats and flat plate of the guide plate. As a result, the ice pieces released from the manufacturing plates are continuously and smoothly guided from the guide plate into a storing room.

16 Claims, 5 Drawing Sheets

ICE PIECE MANUFACTURING APPARATUS

BACKGROUND OF THE INVENTION

1. Field of the Invention

The present invention relates to an ice piece manufacturing apparatus having a guide plate for guiding ice pieces made on a manufacturing plate to a storing room. Specifically, the invention relates to an ice piece manufacturing apparatus in which a guide plate is directly arranged to a manufacturing plate in a state where the guide plate is inclined toward a storing room and a predetermined space necessary to smoothly drop the ice piece from the manufacturing plate onto the guide plate is secured between the manufacturing plate and the guide plate. The ice piece is dropped from the manufacturing plate and guided to the storing room through the guide plate in a smooth manner.

2. Description of the Related Art

Various apparatus have been proposed for manufacturing ice pieces. In such apparatuses, ice pieces are generally manufactured as follows: at first, when a cooling device is driven, a cooling medium is circulated in an ice manufacturing plate to cool down the manufacturing plate. Water used for manufacturing ice pieces is then provided from a water tank to the cooled manufacturing plate through a water providing pump. The water provided to the manufacturing plate is sprinkled over an upper surface of the manufacturing plate. The sprinkled water is gradually frozen and ice pieces are formed on the upper surface of the manufacturing plate. After manufacturing of the ice pieces mentioned above is finished, the ice pieces formed on the upper surface of the manufacturing plate are released from the upper surface by flowing releasing water into the manufacturing plate which is utilized for releasing the ice pieces from the upper surface of the manufacturing plate. The released ice pieces are then guided toward a storing room by a guide plate.

A description of the guide plate installed in the above conventional ice piece manufacturing apparatus will be given hereinafter with reference to FIGS. 5 and 6. FIG. 5 is a sectional view which schematically shows an installing state between the water tank and the guide plate in the conventional ice piece manufacturing apparatus, and FIG. 6 is a perspective view which schematically shows a state where the guide plate is removed from the water tank.

In FIGS. 5 and 6, at both side walls of a water tank 20, a pair of installing portions 21A (in FIG. 6, one of the installing portions 21A is shown) are formed and an installing portion 21B (see FIG. 5) is formed over an upper edge of behind wall of the water tank 20. A guide plate 23 is installed on the water tank 20 through the installing portions 21A, 21B so that the guide plate 23 covers an open plane of the water tank 20 and is inclined and directed toward a storing room 24. Manufacturing plates 22 are arranged at an upper position of the guide plate 23 through a retaining plate (not shown).

According to the above construction, the ice pieces I released from the manufacturing plate 22 are dropped with deadweight thereof on the inclined guide plate 23 and slide into the storing room 24 by being guided through the guide plate 23. At that time, it is conceivable that the ice pieces I are broken and scattered in the apparatus when the ice pieces I are dropped on the guide plate 23. In order to avoid such trouble, a pair of brim portions 25 are formed by upwardly extending both side walls of the water tank 20 from positions where the guide plate 23 is arranged.

Further, as shown in FIG. 5, the nearest space (distance) D which is defined by a distance between the lower end of the manufacturing plate 22 and the upper surface of the guide plate 23 is set so that a suitable distance necessary for releasing the ice pieces I from the manufacturing plate 22 can be secured. That is to say, in case that the nearest space D is too short, the ice pieces I released from the manufacturing plate 22 one by one are simultaneously contacted with both the lower end of the manufacturing plate 22 and the guide plate 23, and thus releasing of the ice pieces I cannot be conducted in a smooth manner. Further, if the ice pieces I are clogged between the manufacturing plate 22 and the guide plate 23, the manufacturing ability of the apparatus goes down and thereby the apparatus cannot manufacture the ice pieces. On the other hand, if the nearest space D is too long, unnecessary space is formed in the apparatus and thus a demand of miniaturizing the apparatus to reduce an installing area thereof cannot be satisfied.

However, in the above conventional apparatus, the brim portion 25 are formed at both side walls of the water tank 20, separately from the guide plate 23 and the guide plate 23 is arranged on both the installing portions 21A formed at inner sides of the brim portions 25 and installing portion 21B formed on the behind wall of the water tank 20. Therefore, a high degree of precision in providing the space between the water tank 20 and the guide plate 23 is necessary in order to smoothly guide the ice pieces I released from the manufacturing plate 22 into the storing room 24. It is, in general, very difficult to form both the water tank 20 and the guide plate 23 with a high degree of precision therebetween, thus there is a problem that the cost of the apparatus cannot be reduced. On the other hand, if precision is not maintained between the guide plate 23 and the water tank 20, it is conceivable that unnecessary space is yielded between the both side edges of the guide plate 23 and the brim portions 25 and, in such case, the ice pieces I are clogged into the yielded space. As a result, the ice pieces I cannot be smoothly guided from the guide plate 23 into the storing room 24.

Moreover, in order to retain manufacturing ability of the ice pieces I, it is necessary to smoothly release the ice pieces I one by one from the manufacturing plate 22. Thus, the nearest space D between the lower end of the manufacturing plate 22 and the guide plate 23 has to be constantly maintained to a suitable space so that the ice pieces I are not clogged therebetween. However, in the above conventional apparatus, the guide plate 23 is arranged along with the open plane of the water tank 20 and the manufacturing plate 22 is arranged in the apparatus by utilizing the retaining plate. Therefore, in order to secure a suitable space between the lower end of the manufacturing plane 22 and the guide plate 23, installing positions of the water tank 20, the guide plate 23, the manufacturing plate 22 and the retaining plate have to be precisely determined with each other and each member has to be correctly installed.

However, since each member of the water tank 20, the guide plate 23, the manufacturing plate 22 and the retaining plate are separately and independently installed in different processes, an installation error occurring among the members when mutually installed cannot be, in fact, taken into consideration. Due to this, it is difficult that the installation relationship between the manufacturing plate 22 and the guide plate 23 is precisely determined and a suitable space necessary to smoothly drop the ice pieces I is constantly secured therebetween. Therefore, there is a problem that ice manufacturing ability of the apparatus goes down due to the fact that a suitable space cannot be secured between the manufacturing plate 22 and the guide plate 23.

SUMMARY OF THE INVENTION

Accordingly, it is an object of the present invention to overcome the above problems and to provide an ice piece manufacturing apparatus in which a guide plate for guiding ice pieces is directly arranged to an ice manufacturing plate in an inclined state where the guide plate directed toward a storing room through an installing member for installing the manufacturing plate in the apparatus, thereby not only a suitable space necessary to smoothly drop ice pieces can be secured between the manufacturing plate and the guide plate through a simple construction without taking severe preciseness between the manufacturing plate and the other member into consideration, but also the ice pieces dropped from the manufacturing plate can be guided into the storing room in a smooth manner.

In order to accomplish the above object, the present invention provides an ice piece manufacturing apparatus including an apparatus body; a cooling unit arranged in the apparatus body; an ice manufacturing member for manufacturing ice pieces by being cooled down through the cooling unit; a retaining member for retaining the ice manufacturing member in the apparatus body; a storing room for storing the ice pieces manufactured by the ice manufacturing member, the storing room being positioned near the ice manufacturing member; and a guide member for guiding the ice pieces manufactured by the ice manufacturing member into the storing room; the ice piece manufacturing apparatus comprising:

a pair of hook members downwardly formed from the retaining member; and a pair of brim members upwardly formed at both sides of the guide member corresponding to each of the hook members, each of the brim members having a hole into which the hook member is hooked;

wherein the guide member is arranged in the apparatus body through the holes formed in the brim members and the hook members formed in the retaining member so that the guide member is inclined toward the storing room.

According no the present invention, the ice manufacturing member arranged in the apparatus body through the retaining member is cooled down by the cooling unit and then the ice pieces are manufactured on the ice manufacturing member. The thus manufactured ice pieces are released from the ice manufacturing member and thereafter are guided through the guide member and stored into the storing room.

At that time, the guide member is arranged in the apparatus body by hooking a pair of the hook members formed in the retaining member into the holes formed in the brim members so that the guide member is inclined toward the storing room. As a result, a distance necessary to smoothly drop the ice pieces from the ice manufacturing member onto the guide member can be secured between the ice manufacturing member and the guide member through the holes formed in the brim members and the hook members formed in the retaining member. Thereby, the ice pieces dropped from the ice manufacturing member can be smoothly guided into the storing room through the guide member by a simple construction in which it is unnecessary to maintain severe preciseness between the ice manufacturing member and the other members.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the accompanying drawings wherein.

DETAILED DESCRIPTION OF THE PREFERRED EMBODIMENTS

Figure 1:
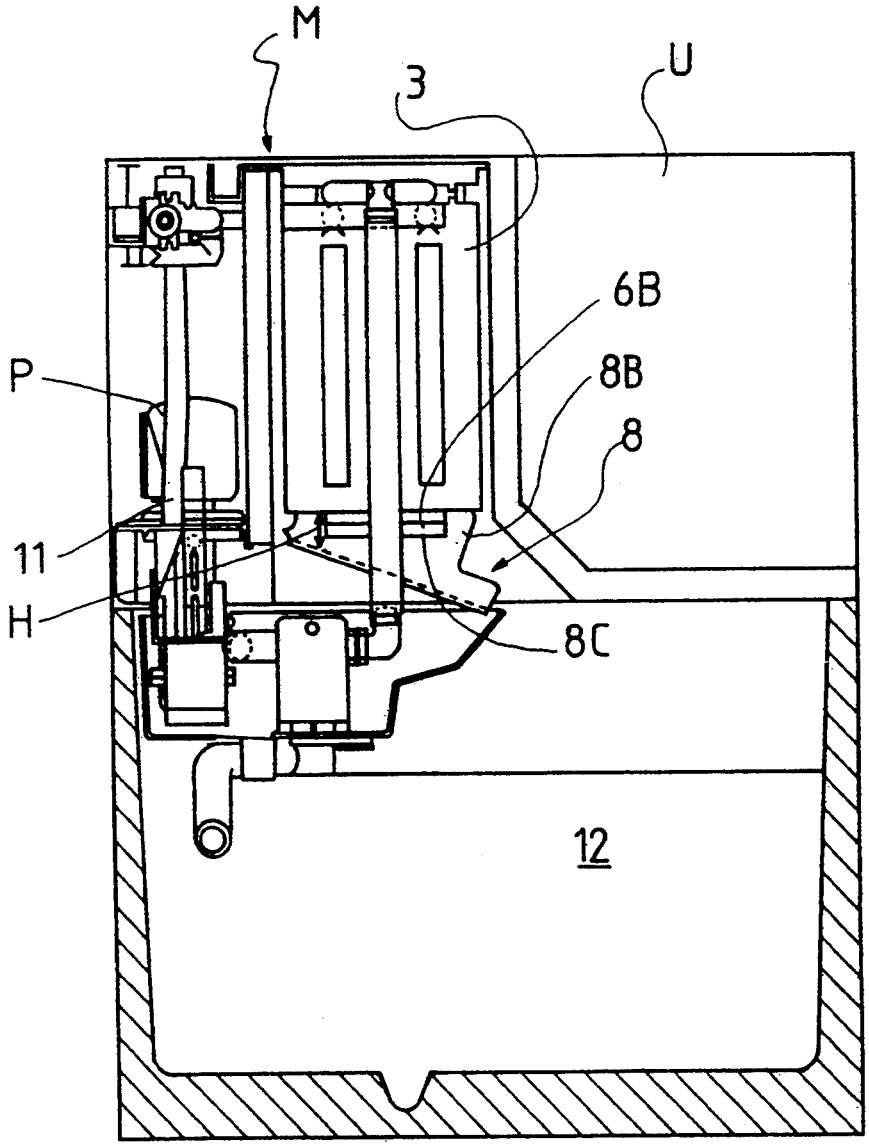
FIG. 1 is a schematic sectional view of an ice piece manufacturing apparatus, in which the apparatus is shown from a behind thereof.

A detailed description of the preferred embodiment according to the present invention will be given referring to FIGS. 1, 2, 3 and 4. In FIG. 1, a cooling unit U is arranged at right upper position in an ice piece manufacturing apparatus M and a pair of ice manufacturing plates 1 are positioned near the cooling unit U, as shown in FIG. 4.

Figure 3:
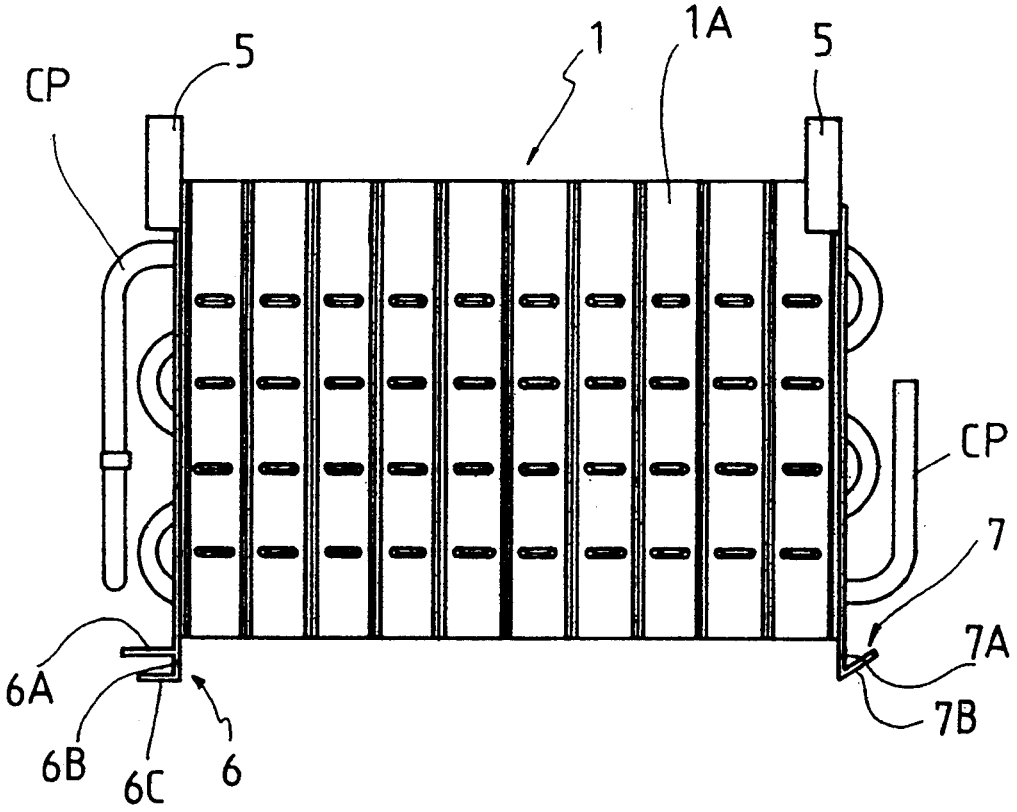
FIG. 3 is a front view of an ice manufacturing plate and a retaining plate.
Figure 4:
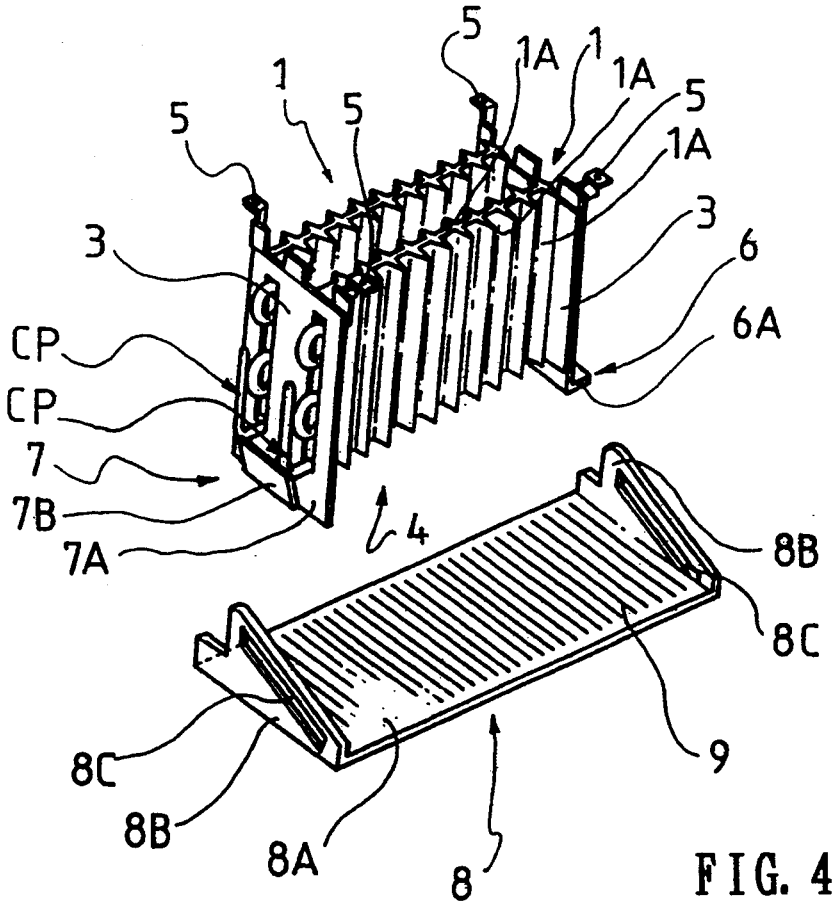
FIG. 4 is a schematic perspective view for explaining an installing relationship between the retaining plate and a guide plate.
Figure 5:
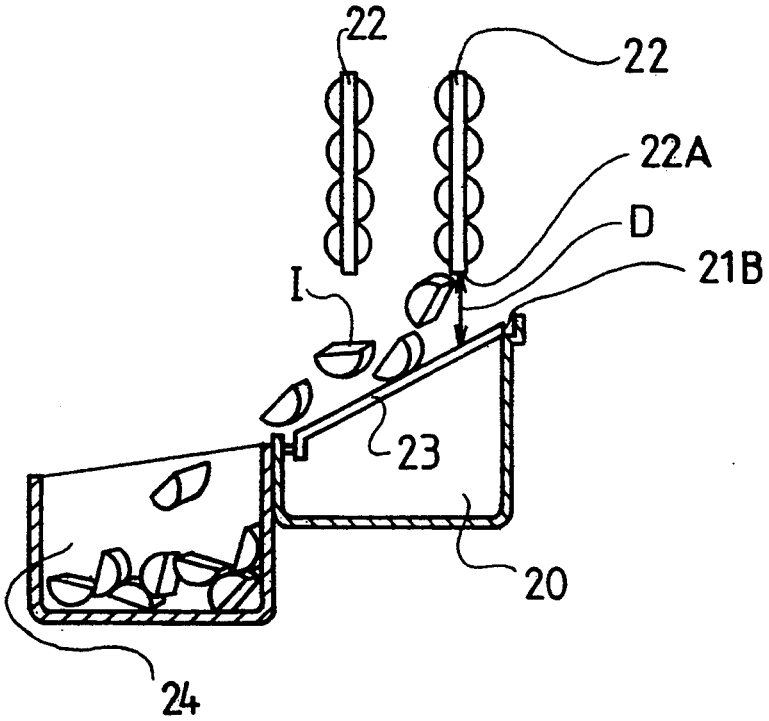
FIG. 5 PRIOR ART
FIG. 5 is a sectional view which schematically shows an installing state between the water tank and the guide plate in the conventional ice piece manufacturing apparatus.
Figure 6:
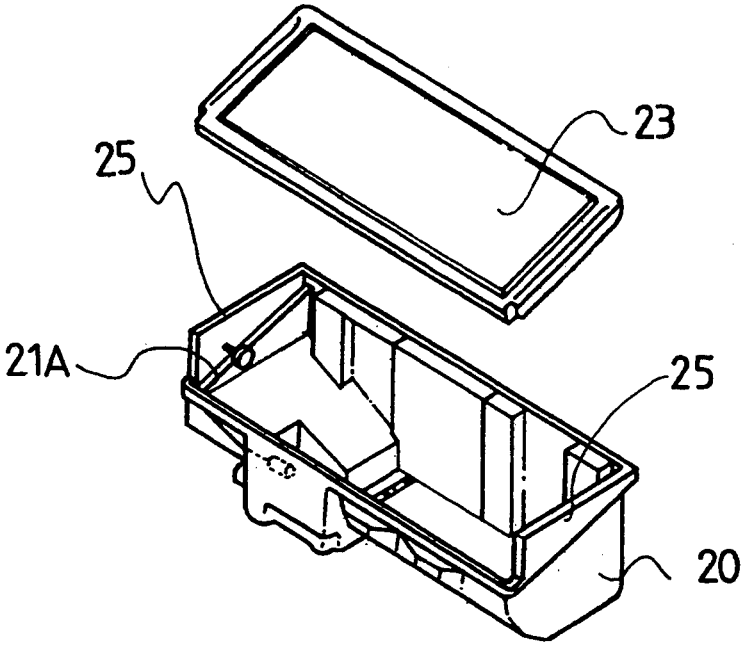
FIG. 6 PRIOR ART
FIG. 6 is a perspective view which schematically shows a state where the guide plate is removed from the water tank.

Each of the manufacturing plates 1 is, as shown in FIGS. 3 and 4, constructed from a pair of metallic plates with low heat conductivity composed of metal such as stainless steel and a plurality of grooves 1A, which are utilized for manufacturing ice pieces therein and vertically extended, are formed on both side surfaces of the manufacturing plate 1. Both manufacturing plates 1 are separately positioned with a predetermined space therebetween and, in such space, cooling pipes CP for circulating cooling medium therein, which is cooled down by the cooling unit U, are arranged. Each manufacturing plate 1 is cooled down through the cooling medium circulated in the cooling pipes CP when manufacturing the ice pieces and the ice pieces are manufactured by freezing the water existing in the grooves 1A, the water being provided onto the surfaces of the manufacturing plates 1 by a water providing pump P (later mentioned).

The thus constructed manufacturing plates 1 are, as shown in FIGS. 3 and 4, retained at side edges thereof by two retaining plates 3 which are arranged vertically. Each of the retaining plates 3 has a pair of installing members 5 formed at both right and left sides in the upper part of the plate 3 (two retaining plates 3 have totally four installing members 5 at four corner positions as shown in FIG. 4) and the retaining plates 3 are fixed to an inner upper wall of the apparatus M through screws as shown in FIG. 1. Further, at a lower end of the right retaining plate 3 in FIG. 4, a hook member 6 is formed, and at a lower end of the left retaining member 3 in FIG. 4, a hook member 7 is formed.

As shown in FIG. 3, the hook member 6 is constructed from a first horizontal portion 6A extended from the lower end of the retaining plate 3, a vertical portion 6B downwardly extended from the lower end of the retaining plate 3 and a second horizontal portion 6C horizontally extended from the lower end of the vertical portion 6B. The hook member 7 is constructed from a lower portion 7A downwardly extended from the lower end of the retaining plate 3 and an inclined portion 7B upwardly extended from the lower end of the lower portion 7A in a state where the portion 7B is upwardly inclined.

An ice guide plate 8 is positioned under the retaining plate 3 as shown in FIG. 1. The guide plate 8 will be described with reference to FIG. 4. The guide plate 8 is constructed from a flat plate 8A on which slits 9 for recovering the water dropped from the manufacturing plates 1 to a water tank 10 (later mentioned) are formed and a pair of brim plates 8B upwardly extended from both side edges of the flat plate 8A. Each of the brim plates 8B is formed in a triangle shape and in each of the brim plates 8B, a long hole 8C is formed parallel to the upper edge of the brim plate 8B. In the long holes 8C, the second horizontal portion 6C in the hook member 6 and the inclined portion 7B in the hook member 7 are hooked, respectively. At that time, when both the horizontal portion 6C and the inclined portion 7B are hooked in the long holes 8C, the flat plate 8A of the guide plate 8 is retained to the retaining plate 3 in an inclined state where the flat plate 8A is inclined with a predetermined angle against the retaining plate 3, because the brim plates 8B are formed in a triangle shape and the long holes 8C are opened therein so as to be positioned parallel to the upper edges of the brim plates 8B.

Here, when the guide plate 8 is installed to the retaining plate 3, the second horizontal portion 6C of the hook member 6 is, at first, hooked into one of the long holes 8C (in FIG. 4, the right long hole 8C) until the brim plate 8B contacts with the vertical portion 6B. Thereafter, the inclined portion 7B of the hook member 7 is hooked into the other long hole 8C (in FIG. 4, the left long hole 8C) and the guide plate 8 is positioned at a position where weight of the plate 8 is balanced. Thereby, the guide plate 8 is installed to the retaining plate 3 with a good balance.

Further, as shown in FIG. 1, the distance H between the lower ends of the manufacturing plates 1 retained to the retaining plate 3 and the flat plate 8A is determined by a height (width) of the vertical portion 6B, the lower portion 7A in the hook members 6, 7 and a height between each of the long holes 8C and the flat plate 8A. Therefore, the distance H is constantly secured between the lower ends of the manufacturing plates 1 and the flat plate 8A of the guide plate 8 without being affected by the other members. Here, the distance H is set in a suitable distance (space) through which the ice pieces I are smoothly released from the manufacturing plates 1, thus releasing of the ice pieces I from the manufacturing plates 1 can be smoothly conducted without being clogged by the ice pieces I in the distance H.

Figure 2:
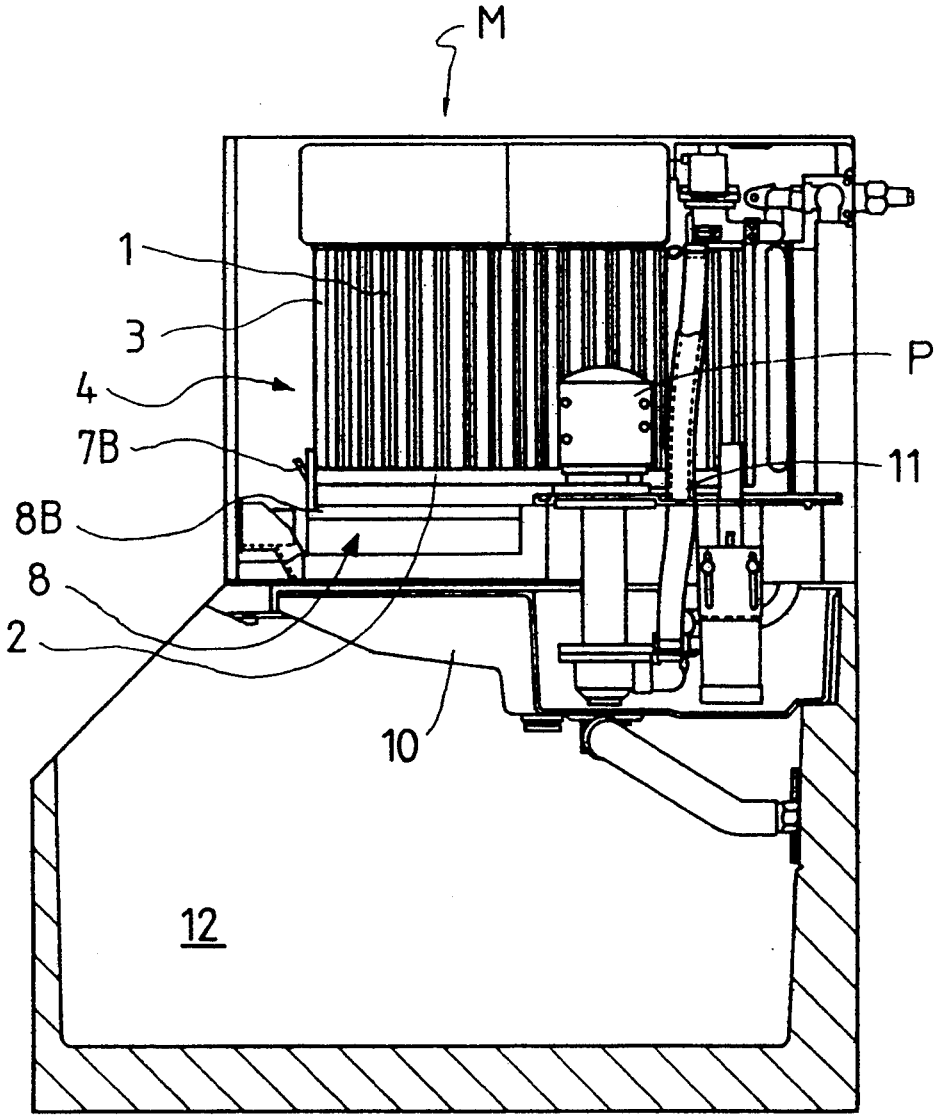
FIG. 2 is a schematic sectional side view of the ice piece manufacturing apparatus.

As shown in FIG. 2, a water tank 10 in which the water to manufacture the ice pieces I is stored is arranged under the guide plate 81. The water stored in the water tank 10 is provided with the manufacturing plates 1 by the water providing pump P and a providing pipe 11. A storing room 12 for storing the ice pieces I is positioned under the water tank 10 and the above guide plate 8 is, as shown in FIG. 1, inclinedly arranged with a predetermined angle toward the storing room 12. Based on the above construction, after the ice pieces I are manufactured on the manufacturing plates 1 and released therefrom, the ice pieces I are guided through the flat plate 8A of the guide plate 8 and dropped into the storing room 12.

The construction of the cooling unit U and construction that the water for manufacturing the ice pieces I and the water for releasing the ice pieces I from the manufacturing plates 1 are provided by the water providing pump P and the providing pipe 11, are conventionally well-known. Thus, detailed description thereof will be omitted.

An operation of the ice piece manufacturing apparatus M constructed according to the above will now be described. First, when the electric power is turned on, the cooling unit U is driven, thereby cooling action of the manufacturing plates 1 in the apparatus M is started. The manufacturing plates 1 are cooled down by circulating the cooling medium from the cooling unit U through the cooling pipe CP, which is arranged between the manufacturing plates 1. The apparatus M is cooled down therein through circulating the cold air yielded from the cooled plates 1.

The water providing pump P sucks up the water stored in the water tank 10 and provides the water with the upper side of the manufacturing plates 1 through the providing pipe 11. The water provided with the upper side of the plates 1 is frozen on the plate 1 and further the water provided on the frozen water is frozen. The ice pieces I are thereby formed on the manufacturing plates 1 and the ice manufacturing process is finished.

After the ice manufacturing process is finished, the water for releasing the ice pieces I from the manufacturing plates 1 is poured between the inner sides of the plates 1 from the water supply. At that time, temperature of the releasing water is higher than 0° C., and thus the manufacturing plates 1 are warmed up from the inner sides thereof. Therefore, the ice pieces I formed on the plates 1 are released from the plates 1. The releasing water poured between the inner sides of the plates 1 and the water yielded when the ice pieces I are released are dropped into the water tank 10 through the slits 9 formed on the flat plate 8A. The recovered water is utilized in manufacturing the ice pieces I. Thereafter, the ice releasing process is finished.

The ice pieces I released from the manufacturing plates 1 are dropped onto the flat plate 8A of the guide plate 8. At that time, the most suitable distance H necessary for smoothly dropping the ice pieces I is secured at the most nearest position where the lower ends of the plates I approaches to the flat plate 8A of the guide plate 8, through the vertical portions 6B, the lower portion 7A of the hook member 6, 7 and the long holes 8C in the brim plates 8B. Therefore, the ice pieces I can be smoothly dropped from the manufacturing plates 1 onto the flat plate 8A of the guide plate 8 without clogging. The thus dropped ice pieces I onto the flat plate 8A are downwardly guided on the flat plate 8A and dropped and stored into the storing room 12. While the ice pieces I are guided on the flat plate 8A, the ice pieces I are limited to move in the right and the left direction (in the long width direction of the guide plate 8) by the brim plates 8B formed at both side edges of the guide plate 8. Therefore, the ice pieces I are prevented from jumping out of the guide plate 8 if the ice pieces I are bounced on the flat plate 8A when dropped.

According to the ice piece manufacturing apparatus of the preferred embodiment, the guide plate 8 is directly installed to the retaining plates 3 through the hook members 6, 7 formed at the lower ends of the retaining plates 3 and the long holes 8C opened in the brim plates 8B formed at both side edges of the guide plate 8. Therefore, the most suitable distance H necessary for smoothly dropping the ice pieces I can be constantly secured between the lower ends of the manufacturing plates 1 and the flat plate 8A. As a result, the ice pieces I released from the manufacturing plates 1 can be continuously and smoothly dropped onto the guide plate 8 without clogging.

Further, the distance H can be flexibly set between the retaining plate 3 and the guide plate 8, without being affected by preciseness of installation of the other various constructing member in the ice piece manufacturing apparatus M. Thus, the suitable distance H necessary for dropping the ice pieces I can be secured through a simple construction and a percentage that substandard articles are produced due to dispersion of the distance H can be remarkably reduced.

Moreover, the distance H can be inspected in an installing process that the retaining plates 3 and the guide plate 8 are installed with each other. Thus, the distance H can be finely adjusted by measuring the distance between the retaining plates 3 and the guide plate 8 in the installing process thereof. Accordingly, based on the preferred embodiment, an ice piece manufacturing apparatus capable of stably manufacturing the ice pieces I can be realized, since the ice pieces I released from the manufacturing plates 1 are smoothly guided on the guide plate 8 because of the suitable distance H.

In the apparatus of the embodiment, the brim plate 8B are directly formed at both side edges of the guide plate 8 and thus it is unnecessary to correspond the shape of the water tank 10 to the shape of the guide plate 8. Therefore, the water tank 10 can be formed corresponding to a surplus space in the apparatus M. Similarly to the above, the water tank 10 can be independently installed from the installing position of the guide plate 8 and thus the other members can be arranged in a big space secured over the water tank 10 by flexibly arranging the water tank 10. Further, the installing space can be reduced and the size can be miniaturized by breaking the relationship between the guide plate 8 and the water tank 10, which relationship necessarily exists in the conventional apparatus.

While the invention has been particularly shown and described with reference to preferred embodiments thereof, it will be understood by those skilled in the art that the foregoing and other changes in form and details can be made therein without departing from the spirit and scope of the invention. For instance, though the retaining plates 3 and the guide plate 8 are installed with each other by hooking the hook members 6, 7 into the long holes 8C, it is conceivable that the long holes 8C are opened in the retaining plates 3 and the hook members 6, 7 are formed in the brim plates 8B.

What is claimed is:

1. An ice piece manufacturing apparatus including an apparatus body; a cooling unit arranged in the apparatus body; an ice manufacturing member for manufacturing ice pieces by being cooled down through the cooling unit; a retaining member for retaining the ice manufacturing member in the apparatus body; a storing room for storing the ice pieces manufactured by the ice manufacturing member, the storing room being positioned near the ice manufacturing member; and a guide member for guiding the ice pieces manufactured by the ice manufacturing member into the storing room; the ice piece manufacturing apparatus comprising:

a pair of hook members downwardly formed from the retaining member; and a pair of brim members upwardly formed at both sides of the guide member corresponding to each of the hook members, each of the brim members having a hole into which the hook member is hooked;

wherein the guide member is arranged in the apparatus body through the holes formed in the brim members and the hook members formed in the retaining member so that the guide member is inclined toward the storing room.

2. The ice piece manufacturing apparatus according to claim 1, wherein the ice manufacturing member comprises a pair of ice manufacturing plates and the retaining member comprises a pair of retaining plates between which the ice manufacturing plates are retained.

3. The ice piece manufacturing apparatus according to claim 2, wherein each of the retaining plate has a pair of installing portions through which the retaining plates retaining the ice manufacturing plates are installed in the apparatus body.

4. The ice piece manufacturing apparatus according to claim 2, wherein each of the ice manufacturing plates is composed of metallic material with low heat conductivity.

5. The ice piece manufacturing apparatus according to claim 4, wherein the metallic material is stainless steel.

6. The ice piece manufacturing apparatus according to claim 2, wherein the hook members comprise a first hook member downwardly formed from one of the retaining plates and a second hook member downwardly formed from the other of the retaining plates.

7. The ice piece manufacturing apparatus according to claim 6, wherein the first hook member comprises a first horizontal portion which is horizontally formed from a lower end of the one retaining member, a vertical portion which formed from the lower end of the one retaining plate and a second horizontal portion which is horizontally formed from a lower end of the vertical portion.

8. The ice piece manufacturing apparatus according to claim 7, wherein the second hook member comprises a lower portion which is formed from a lower end of the other retaining plate and an inclined portion which is formed from a lower end of the lower portion so as to be upwardly inclined.

9. The ice piece manufacturing apparatus according to claim 8, wherein each of the brim members is formed into a triangle shape and the hole opened in each of the brim members is a long hole parallel to an upper edge of the brim member.

10. The ice piece manufacturing apparatus according to claim 9, wherein the second horizontal portion of the first hook member is hooked into the long hole formed in one of the brim members and the inclined portion of the second hook member is hooked into the long hole formed in the other of the brim members.

11. The ice piece manufacturing apparatus according to claim 1, wherein the guide member has a flat plate between the brim members.

12. The ice piece manufacturing apparatus according to claim 11, further comprising a water tank for providing water to the ice manufacturing member, the water tank being arranged under the guide member.

13. The ice piece manufacturing apparatus according to claim 12, further comprising slits formed on the flat plate and wherein the water dropped from the ice manufacturing member is restored in the water tank through the slits.

14. The ice piece manufacturing apparatus according to claim 1, wherein the guide member is separated from the ice manufacturing member with a distance through the retaining member.

15. The ice piece manufacturing apparatus according to claim 14, wherein the distance is determined so that the ice pieces manufactured on the ice manufacturing member are smoothly dropped onto the guide member.

16. An ice piece manufacturing apparatus including an apparatus body; a cooling unit arranged in the apparatus body; a pair of ice manufacturing plates for manufacturing ice pieces by being cooled down through the cooling unit; a pair of retaining plates for retaining the ice manufacturing plates at both sides thereof in the apparatus body; a storing room for storing the ice pieces manufactured by the ice manufacturing plates, the storing room being positioned near the ice manufacturing plates; and a guide plate having a flat portion for guiding the ice pieces manufactured by the ice manufacturing plates into the storing room through the flat portion; the ice piece manufacturing apparatus comprising:

a pair of hook members downwardly formed from each of the retaining plates; and a pair of brim members upwardly formed at both sides of the flat portion corresponding to each of the hook members, each of the brim members having a long hole into which the hook member is hooked;

wherein the guide member is arranged in the apparatus body so that the guide member is inclined toward the storing room and the ice pieces are guided on the flat portion into the storing room by hooking the hook members into the long holes.

* * * * *